US007426996B2

(12) United States Patent
Pippin et al.

(10) Patent No.: US 7,426,996 B2
(45) Date of Patent: Sep. 23, 2008

(54) MAIL DISTRIBUTION APPARATUS AND METHOD

(75) Inventors: James M. Pippin, Keller, TX (US); Homer L. Dickerson, Ft. Worth, TX (US); Manfred Vogt, Bedford, TX (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 34 days.

(21) Appl. No.: 11/128,494

(22) Filed: May 13, 2005

(65) Prior Publication Data

US 2005/0269249 A1 Dec. 8, 2005

Related U.S. Application Data

(60) Provisional application No. 60/570,788, filed on May 13, 2004.

(51) Int. Cl.
*B07C 5/00* (2006.01)

(52) U.S. Cl. ..... 209/630; 209/629; 209/702; 229/120; 229/120.02

(58) Field of Classification Search ..... 209/630, 209/702, 720; 229/120.02, 120.05, 120
See application file for complete search history.

(56) References Cited

U.S. PATENT DOCUMENTS

| | | | | |
|---|---|---|---|---|
| 254,836 | A | 3/1882 | Nauerth | |
| 1,418,403 | A * | 6/1922 | Smith | 383/38 |
| 2,904,899 | A * | 9/1959 | Lloyd | 434/109 |
| 3,167,074 | A | 1/1965 | Toms | 129/16 |
| 3,718,277 | A * | 2/1973 | Volkert | 229/301 |
| 3,732,978 | A | 5/1973 | Reader | 209/122 |
| 3,858,792 | A * | 1/1975 | Volkert | 229/301 |
| 4,493,684 | A | 1/1985 | Bolton | 493/234 |
| 4,593,816 | A | 6/1986 | Langenbeck | 206/425 |
| 4,789,248 | A | 12/1988 | Penas | 383/38 |
| 4,802,773 | A | 2/1989 | Gross | 383/16 |
| 4,836,428 | A | 6/1989 | Evans et al. | 224/253 |
| 4,979,705 | A | 12/1990 | Bovitz | 248/97 |
| 5,000,325 | A | 3/1991 | D'Elia | 209/702 |
| 5,123,676 | A * | 6/1992 | Donnelly et al. | 283/37 |
| 5,190,252 | A | 3/1993 | Schrager | 248/97 |
| 5,238,139 | A | 8/1993 | Bisceglia | 220/404 |
| 5,489,120 | A * | 2/1996 | Thornsburg | 281/33 |
| 5,613,606 | A * | 3/1997 | Meyer | 206/449 |
| 5,804,265 | A | 9/1998 | Saad et al. | 428/35.2 |
| 5,845,826 | A * | 12/1998 | Nguyen | 224/222 |
| 6,126,201 | A * | 10/2000 | Pace et al. | 281/29 |
| 6,234,701 | B1 * | 5/2001 | Karten et al. | 402/73 |
| 7,140,498 | B2 * | 11/2006 | Pippin et al. | 211/12 |
| 2002/0031284 | A1 | 3/2002 | Pippin et al. | 383/37 |
| 2002/0079255 | A1 * | 6/2002 | Anderson | 209/703 |
| 2002/0164088 | A1 * | 11/2002 | Collins | 383/10 |
| 2003/0208298 | A1 | 11/2003 | Edmonds | 700/224 |
| 2004/0168993 | A1 | 9/2004 | Pippin et al. | 211/12 |

* cited by examiner

*Primary Examiner*—Patrick Mackey
*Assistant Examiner*—Terrell H Matthews

(57) ABSTRACT

A system for manual delivery of mail to a series of recipients includes a stack of mail holders each comprising a front flap, a back flap and a central fold. One or more mail pieces are disposed in each holder, such that all of the mail pieces in each holder are to be delivered to the same recipient. The holders are stacked in a predetermined order for a carrier delivery route, and may be banded or otherwise secured together until the time of delivery.

5 Claims, 12 Drawing Sheets

MAIL DISTRIBUTION APPARATUS AND METHOD

This application claims priority of U.S. Provisional Application Ser. No. 60/570,788, filed May 13, 2004.

BACKGROUND OF THE INVENTION

Each day more than 200,000 United States Postal Service (USPS) carriers deliver mail to approximately 100 million individual domestic addresses. Much of this mail is delivered via a park and loop method wherein the mail carrier drives to a location on his or her route, separates mail destined for a particular loop of addresses and walks the loop, delivering mail pieces to addresses on the loop. Other mail is delivered via the curbside method where the carrier drives his route, stopping to deliver mail pieces to individual addresses.

The mail delivered by the carriers typically comprises letters, flats (including enveloped and non-enveloped magazines) and parcels. As used herein "letter sized" or "letter" generally refers to envelopes, postcards and similar mail pieces having dimensions up to about 6"×11". "Flats" as used herein generally refers to larger, flat mail pieces having dimensions larger than about 6"×11" and having a thickness up to about 0.75", and includes catalogues, magazines, larger envelopes and similar items.

Currently, the carrier normally assembles one or more stacks of letters, flats and parcels and places the individual mail pieces in delivery order or another appropriate sequence for efficient delivery. At each address the carrier riffles or thumbs the stack or stacks, finding the first and last letter addressed to the address selecting the items for that address. The mail carrier places these mail pieces into the postal patron's mailbox and repeats the operation for the next address. Sorting or riffling through the stack or stacks of mail is time consuming and inefficient. Consequently, any reduction in the amount of time required to separate the mail for delivery presents an opportunity for increased efficiency.

In Pippin et al. U.S. Patent Applications 20020031284, published Mar. 14, 2002, and 20040168993, published Sep. 2, 2004, a mail case system facilitates sequence-sorting various types of mail together into individual bags that each represent unique delivery points. The mail case uses multi-bag inserts so that the bags for several stops can be set up quickly for sorting. At the end of the sorting operation, the entire insert may be pulled down from the case as a single unit to maintain the established delivery point sequence. This eliminates the carrier's need to find separation points or to combine selections from multiple sequenced stacks of mail during the delivery operation.

Edmonds U.S. Patent Application 20030208298, Nov. 6, 2003 describes a sorting and packaging system comprises an induction and scanning system, a single pass sorting and packaging system for automatically sorting and packaging a plurality of mailpieces based on a single scan by the induction and sorting system, and a control unit connected to and controlling the induction and scanning system and the single pass sorting and packaging system. The single pass sorting and packaging system comprises at least one cell rack, at least one packaging system, and at least one delivery system. The package may comprise a bag removably surrounding the at least one mail piece addressed to a specific address.

The use of bags for packaging mail for delivery remains problematic in view of the potential cost of such bags, the difficulty of getting the mail into a bag, and the recycling problem presented by the large number of bags that would be required. The present invention addresses these difficulties.

SUMMARY OF THE INVENTION

A mail holder according to one aspect of the invention includes a series of flexible plastic divider sheets each having a handhold opening near an inside edge of the sheet and means for uniting the divider sheets in a stack along the inside edge with the handhold openings substantially in registration with one another. The handhold opening enable a user to turn over a topmost one of the divider sheets with one hand while holding the mail holder or mail contained therein with the other hand positioned in a handhold opening. The uniting means may be an accordion style spine, a single edge spine, rings that hold the divider sheets together in loose leaf fashion, or fasteners such as clamps. In one aspect, the spine is interrupted at the handhold openings, forming spaced, inner and outer spine portions on opposite sides of the handhold opening. In another, an accordion style spine has at least one fold line parallel to the inner edges of the sheets between adjacent pairs of divider sheets, permitting the mail holder to collapse accordion style. In another aspect, the mail holder is provided with top and/or bottom cover sheets that are stiffer than the divider sheets.

A method of the invention for manually distributing mail from a mail holder that includes a series of flexible divider sheets each having a handhold opening near an inside edge thereof and one or more mail pieces inserted between each of the divider sheets, wherein the mail pieces are separated into delivery groupings by the divider sheets, includes the steps of: (a) turning over a topmost one of the divider sheets with one hand while holding the mail holder or mail contained therein with the other hand positioned in a handhold opening, (b) removing mail that was beneath the topmost divider sheet; (c) placing the removed mail into a mail receptacle, (d) then repeating steps (a)-(c) for the next divider sheet and mail beneath that divider sheet, wherein the mail receptacle is different for each repetition of steps (a)-(c), until all mail has been removed from the mail holder. In one variation, the method includes the step of loading mail into the holder according to a predetermined delivery scheme. In this regard, the mail may be loaded into the pockets of the holder in delivery point order.

In another aspect, the invention provides a system for manual delivery of mail to a series of recipients, includes a stack of mail holders in the form of folders each comprising a front flap, a back flap and a central fold with one or more mail pieces disposed in each folder. All of the mail pieces in each folder are to be delivered to the same recipient, and the folders are stacked in a predetermined order for a carrier delivery route. The folders may be provided with areas of releaseable contact adhesive on the inner faces of the front and back flaps to aid in retaining mail pieces therein. Each folder may have also have the address of a recipient of the mail pieces printed on an outside surface of one or both of the front and back flaps to facilitate delivery.

In yet another variation, the invention provides a method of manually distributing a batch of mail to recipients having addresses on a carrier delivery route, including the steps of: (a) placing mail pieces for delivery to each address along the carrier route in a series of pockets formed by mail holders with mail pieces for delivery to each address being placed in a separate pocket, each of the mail holders having the address of the recipient of those mail pieces printed on an outside surface of the holder; (b) stopping at an address corresponding to an address on a holder; (c) selecting the holder for that address; (d) one of:

(i) removing the mail pieces from the holder and placing the mail pieces into a mail receptacle corresponding the address appearing on the holder; and (ii) placing the holder with the mail pieces into a mail receptacle corresponding to the address appearing on the holder; and then, (e) repeating steps (b)-(c) for the next holder, wherein the mail receptacle is different for each repetition of steps (b)-(c), until the batch of mail has been delivered. These and other aspects of the invention are further discussed in the detailed description that follows.

DETAILED DESCRIPTION

Figure 1:
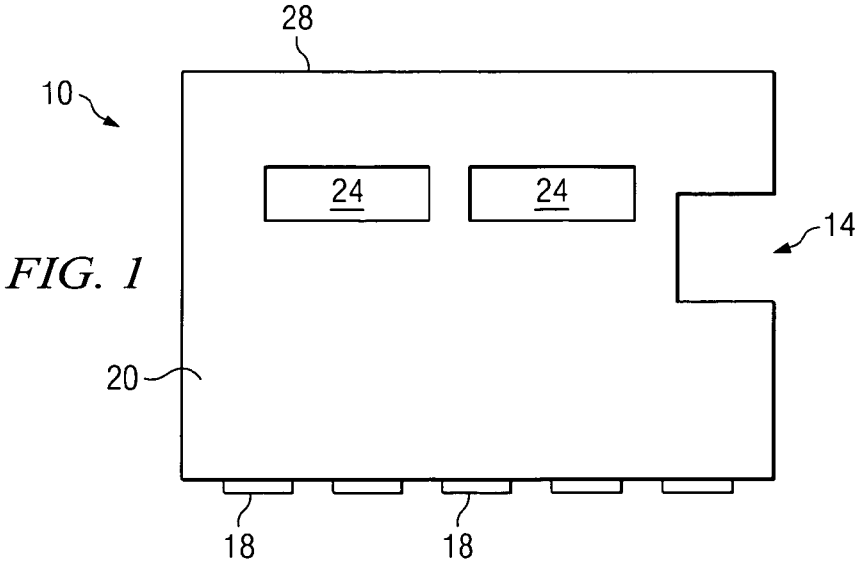
FIG. 1 is a top view of a mail holder according to the invention.

Referring to FIGS. 1-5, a mail holder 10 according to the invention includes a stacks of flexible divider sheets 12 each having a handhold opening 14 formed near an inside edge 16 of the sheet such that each handhold openings 14 is substantially aligned or registered with each of the other handhold openings. Preferably divider sheets 12 are formed from a relatively thin flexible plastic such as polyethylene or polypropylene that is resilient and which possess a limited degree of stiffness. Divider sheets 12 should be sufficiently large to hold a variety of mail, including postcards, letters, magazines and catalogues. In one embodiment, divider sheets are approximately 9 inches high (along the inside edge) and 12 inches wide, however the dimensions of sheets 12 may be varied based upon the mix of mail to be placed in the holder.

As illustrated, divider sheets 12 may each include a tab 18 for labeling the individual sheets with an address or other information. A cover 20, also formed from a material such as polyethylene or polypropylene supports holder 10 when in use. Cover 20 should be sufficiently rigid so as to prevent holder 10 from buckling when the holder is fully loaded with mail. One or more transparent pockets 24 may be formed on the outside surface of cover 20 for labeling purposes such as identifying a series of address corresponding to a delivery loop.

Figure 3:
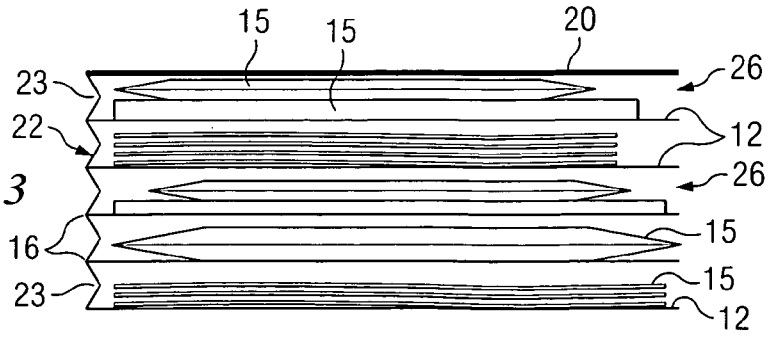
FIG. 3 is a side view of the mail holder of FIG. 1, with mail pieces inserted in the holder pockets.

As best illustrated in FIG. 3, the inside edges 16 of divider sheets 12 are connected with an accordion style spine 22 to form a series of pockets 26 each configured to receive mail pieces 15 destined for delivery to a single address. Spine 22 includes at least one fold line 23 between adjacent divider sheets 12 formed parallel to inside edges 16. Fold lines 23 enable spine 22 to collapse accordion style when empty. Preferably, pockets 26 are open along three sides and joined only along inside edges 16.

Figure 8:
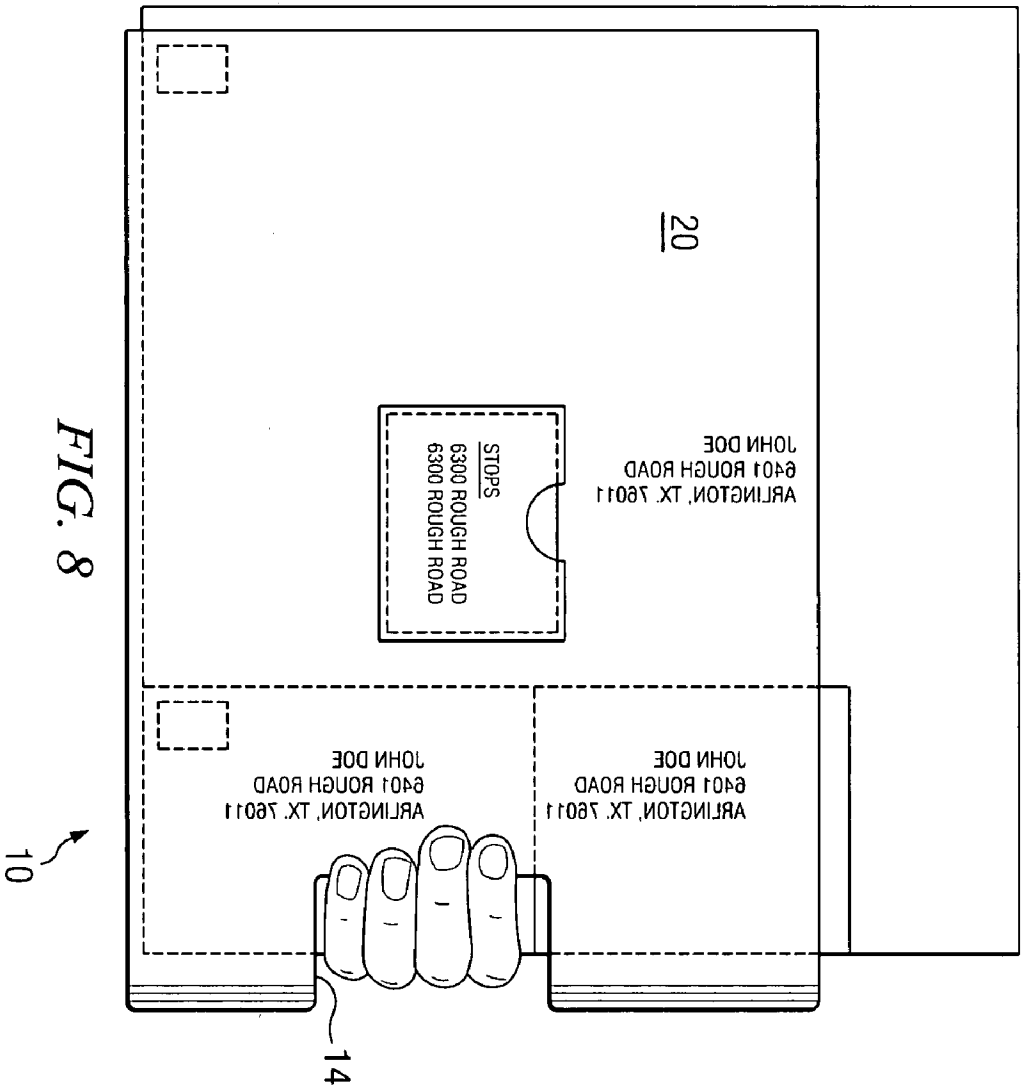
FIG. 8 is a top view illustrating the position of a carrier's hand in the handhold opening of a mail holder according to the invention.

Typically, a carrier will load mail in delivery order in pockets 26, with the mail for the first address in the upper most pocket. The carrier registers or aligns the end of each mail piece 15 against spine 22 with the lower edges 19 of mail pieces 15 being substantially aligned with the near edge 28 of divider sheets 12. The near edge 28 of divider sheets 12 is the edge of the sheets closest to the carrier's body when holder 10 is held as illustrated in FIG. 8. In the case of a park and loop carrier, holder 10 will typically have between six and sixteen sheets 12 that form five to fifteen mail pockets 26, respectively. In some applications however, holder 10 could have as few as one or as many as fifty pockets 26.

Figure 7A:
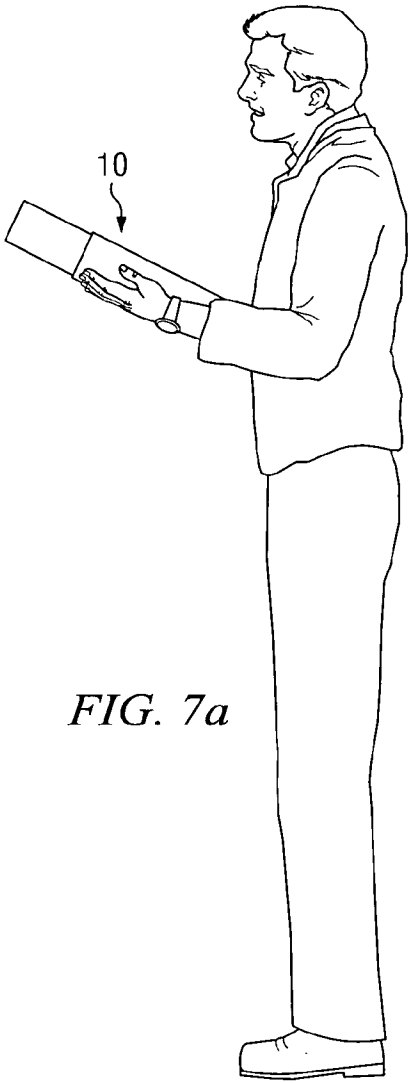
FIGS. 7 and 7*a* are top and side representations of a mail carrier holding a mail holder according to the invention.
Figure 7:
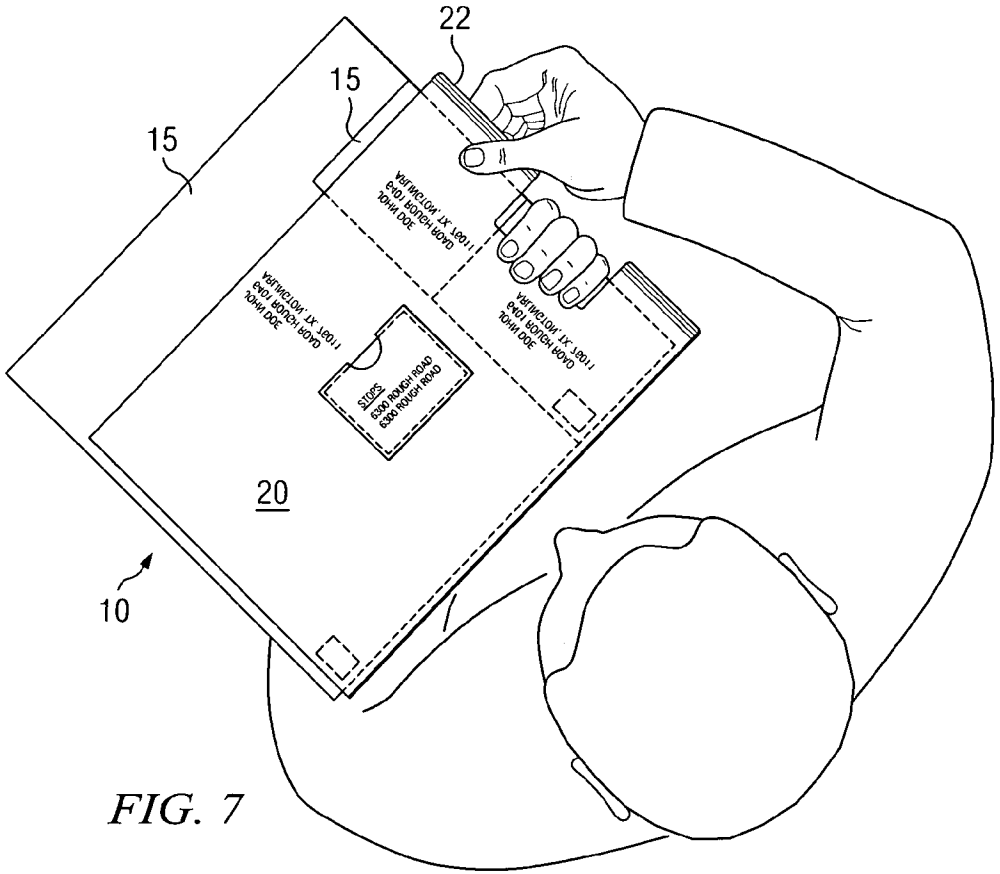
Figure 9:
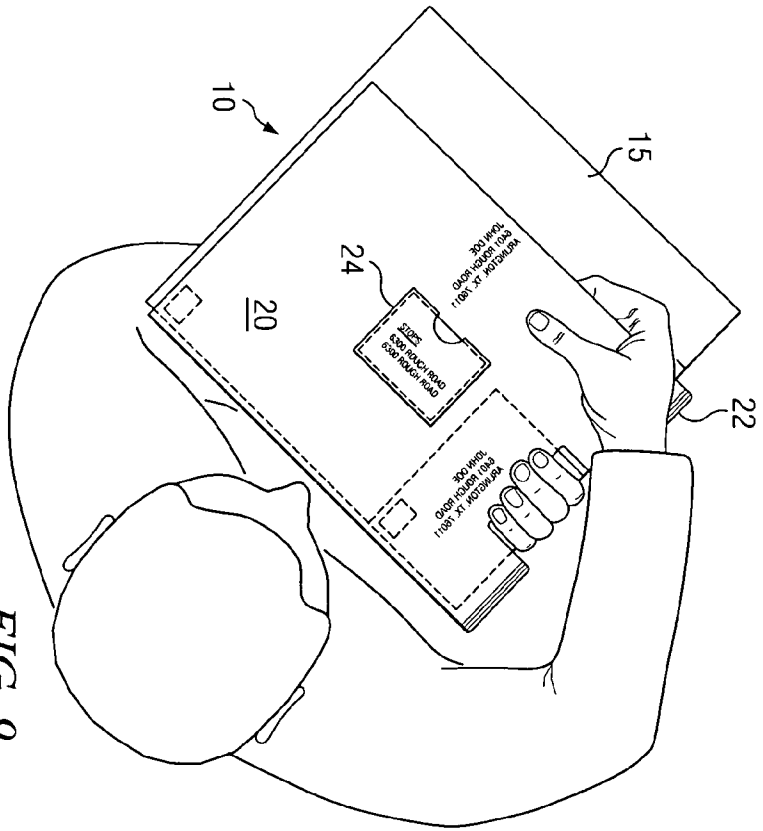
FIG. 9 is a top view of a user opening the cover of a mail holder according to the invention.
Figure 10:
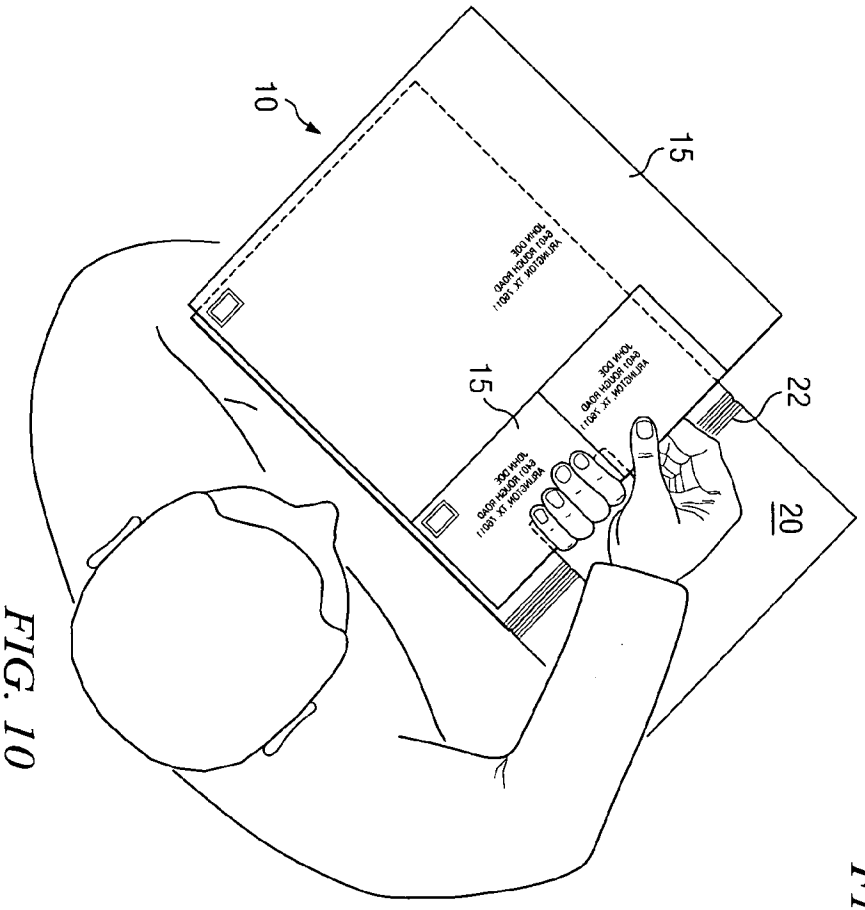
FIG. 10 is a top view of a user removing mail pieces from a mail holder according to the invention.

Referring now to FIGS. 7-10, while delivering mail on a loop, a right handed carrier using mail holder 10 will typically position mail holder 10 against his or her left forearm with cover 20 facing up. The carrier holds or carries holder 10 with the fingers of his or her left hand in handhold opening 14 to control mail pieces 15 as illustrated in FIGS. 7 and 8. Since each handhold opening 14 is substantially aligned or registered with each of the other handhold openings, the carrier can then turn or flip over cover 20 or the topmost divider sheet 12 with his or her right hand opening the uppermost pocket 26 as illustrated in FIG. 9. The mail carrier simultaneously controls mail pieces 15 by applying pressure to mail pieces 15 with his or her left hand through handhold opening 14. As best illustrated in FIG. 10, the carrier then grasps mail pieces 15 in pocket 26 with his right hand, briefly reducing the amount of pressure applied with his left hand as he removes the mail pieces 15 from the pocket. After delivering mail pieces 15, the mail carrier moves to the next address, opening the next pocket 26 and extracting the mail for that address.

Since the mail carrier may rely on tactile sensation to distinguish between divider sheets 12 and mail pieces 15 when walking between addresses, sheets 12 preferably have a surface texture that is sufficiently different from the surface texture of mail pieces to enable the mail carrier to distinguish the sheets from mail pieces 15 by means of touch. Sheets 12 may be also colored in such a fashion as to distinguish the sheets from mail piece 15 carried in holder 10. Sheets 12 may also be transparent or opaque. Since the carrier has already loaded mail for individual addresses in delivery order in pockets 26, the carrier does not need to visually inspect the mail pieces in order to separate mail for different addresses. The use of opaque divider sheets 12 may also prevent the tendency of the carrier to examine mail pieces 15 carried in holder 10.

Figure 4:
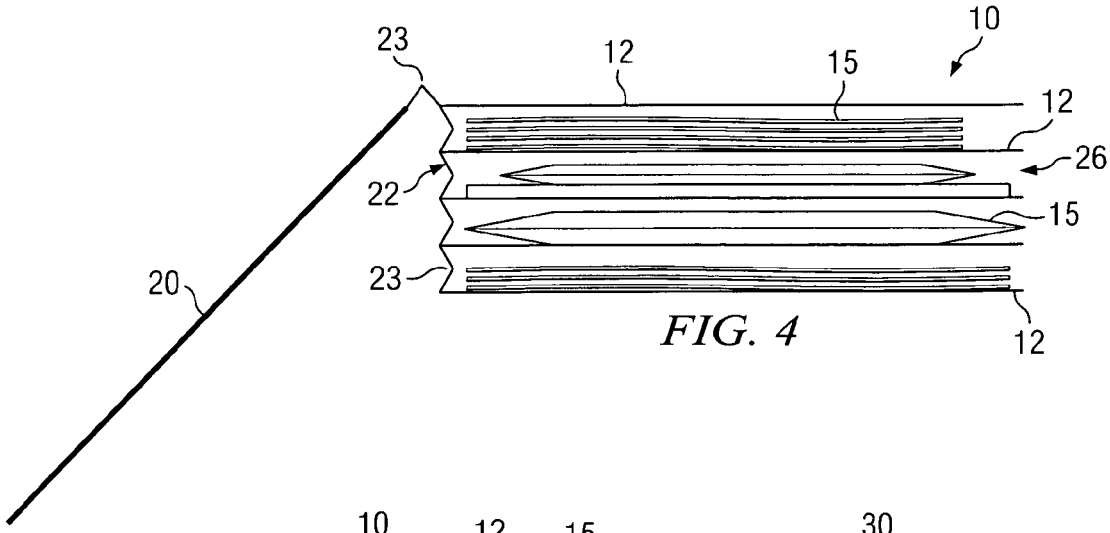
FIG. 4 is a side view of the mail holder of FIG. 5 with the uppermost pocket of the holder opened and the cover turned over.

Referring again to FIGS. 1-5, in the case where addresses on a carrier's route typically receive large mail pieces or a relatively high number of small mail pieces, the configuration of accordion type spine 22 is particularly desirable. Accordion style spine 22 allows divider sheets 12 to be pushed apart as mail pieces are loaded into pockets 26, increasing the capacity of each pocket and of holder 10. Depending upon the particular application, the width of accordion style spine 22 may vary from 0.5 to 1.5 inches. The accordion style configuration of spine 22 also allows sheets 12 to fall open as illustrated in FIGS. 4 and 9, as mail is extracted from successive pockets.

Figure 2:
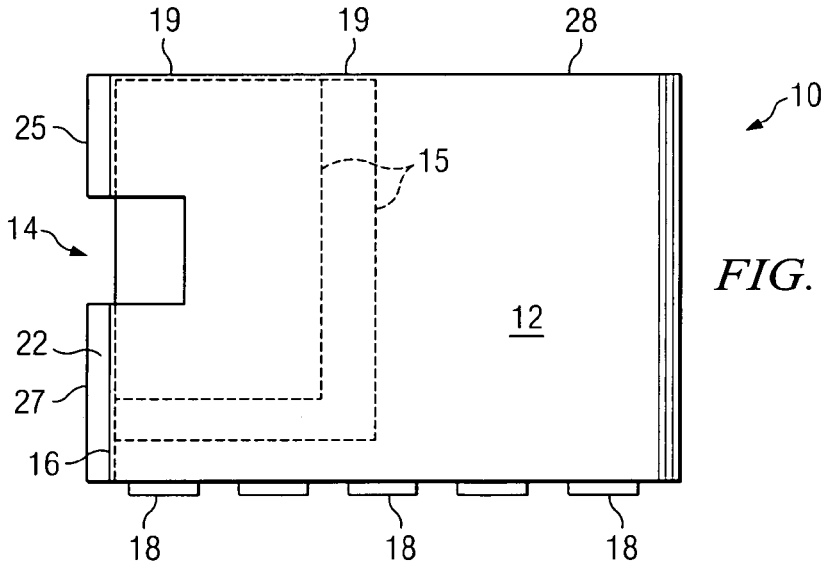
FIG. 2 is a bottom view of the mail holder of FIG. 1.

As best shown in FIGS. 1 and 2, handhold opening 14 is preferably offset toward the near edge 28 of divider sheets 12, dividing spine 22 into inner and outer spine portions 25 and 27 respectively. Offsetting handhold opening 14 in this manner enables the carrier to grasp small mail pieces, the bottom edges of which will be substantially aligned with near edge 28 when the mail pieces 15 are placed in pockets 26. Handhold opening 14 may be rectangular, semicircular or have some other geometry so long as the carrier is able to grasp mail pieces 15 through the opening. In one variation, handhold opening 14 measures approximately 3.5 to 4 inches tall and extends approximately 1.5 to 2.5 inches inwardly from the inside edge 16 of sheets 12 to accommodate a range of hand sizes.

Figure 5:
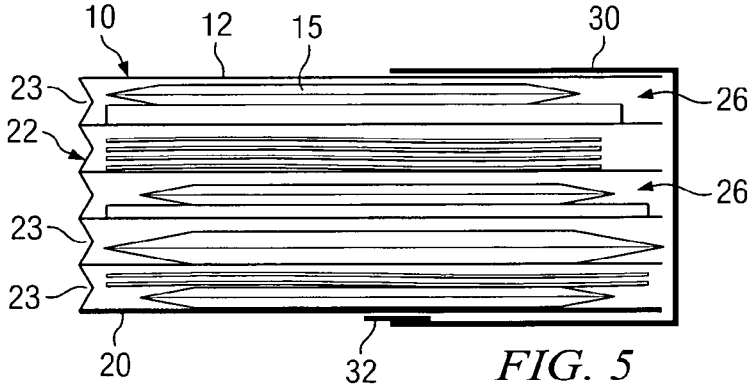
FIG. 5 is a side view of the mail holder of FIG. 3 with a retaining strap installed.
Figure 6:
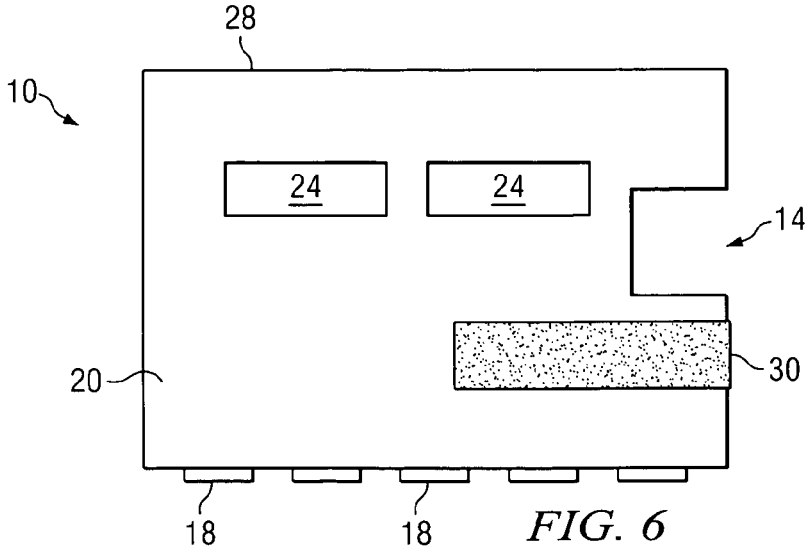
FIG. 6 is a top view of the mail holder of FIG. 5.

Referring to FIGS. 5 and 6, in one variation, a strap or band 30 is used to contain mail pieces 15 in holder 10. Strap 30 is permanently secured to cover 20 and may be fastened to the top divider sheet 12 with a velcro strip 32 or alternatively, a snap, button or other fastener when in use. Preferably, strap 30 is tensioned around holder 10 such that the strap compresses holder 10, causing a normal force between mail pieces 15 and divider sheets 12. The normal force tends to control mail pieces 15 as holder 10 is handled, maintaining the mail pieces in position against spine 22. Alternatively, a removable elastic or non-elastic band or strap may be applied to holder 10 either by hand or with a banding machine to contain mail pieces 15 in holder 10.

Figure 11:
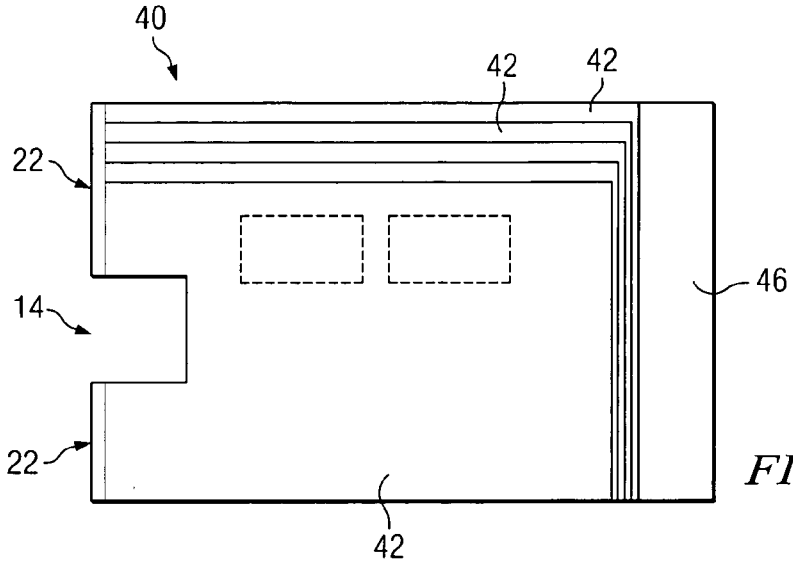
FIGS. 11 and 12 are bottom and side views of an alternative mail holder according to the invention.
Figure 12:
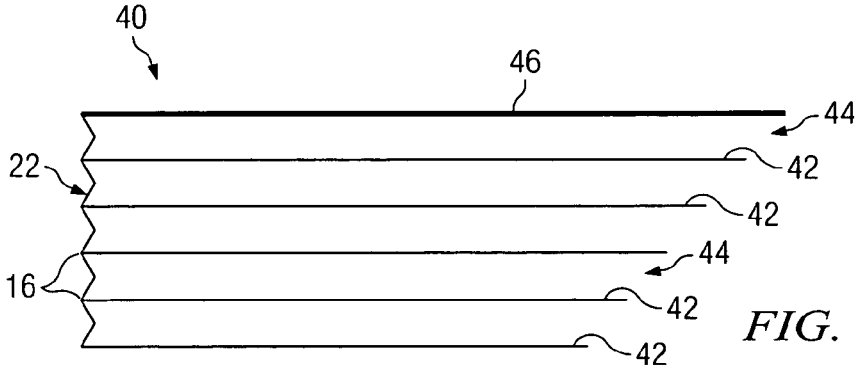

Turning to FIGS. 11 and 12 in another variation, a mail piece holder 40 similar to mail piece holder 10 of FIGS. 1-3 includes a plurality of graduated width flexible divider sheets 42 and a cover 46 joined together with accordion style spine 22 to form a plurality of pockets 44. As illustrated, the width of divider sheets 42 increases from the bottom most sheet 42 to cover 46, with the widest sheet 42 immediately adjacent cover 46. Also, as illustrated in this variation, cover 46 is longer than sheets 42. Graduating the width of sheets 42 enables the carrier to more readily distinguish sheets 42 from mail pieces by means of touch.

Figure 13:
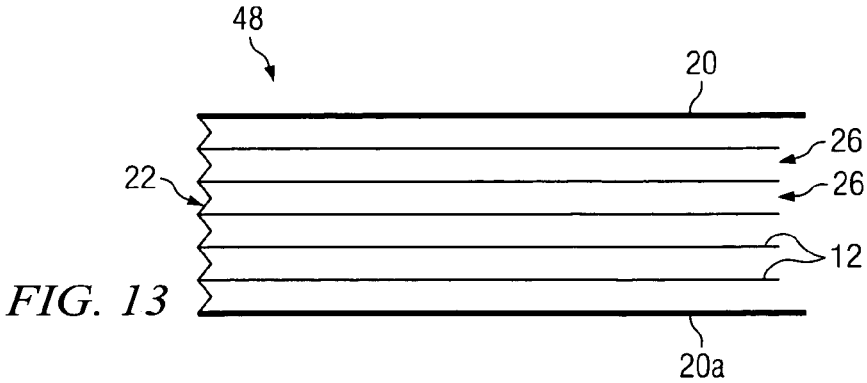
FIG. 13 is a side view of a mail holder according to the invention wherein the holder is provided with top and bottom support sheets.

Referring to FIG. 13, in another variation, a mail piece holder 48 substantially identical to mail piece holder 10 of FIGS. 1-3 is provided with an opposing second cover **20*a*, substantially identical to cover 20. Second cover 20*a* enables a left handed user to employ mail holder 48 in substantially the same manner as described in connection with FIGS. 7-10 with the holder inverted. Thus, the left handed user will typically position mail holder 48 against his or her right forearm with the fingers of his or her right hand in handhold opening 14 to control mail pieces 15 and use his left hand to open pockets 26**.

Figure 14:
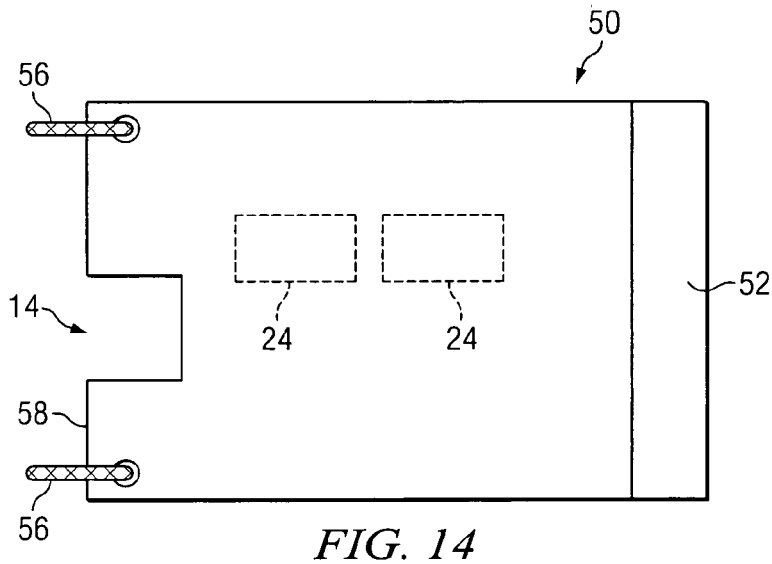
FIGS. 14 and 15 are bottom and side views of a mail holder according to the invention wherein rings are used to fasten divider sheets together.
Figure 15:
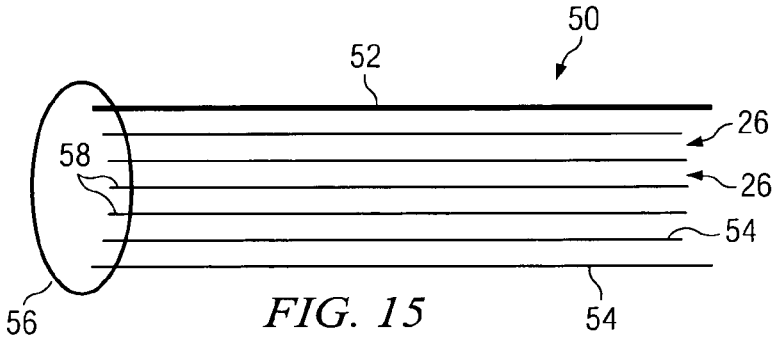

Referring now to FIGS. 14 and 15, a mail piece holder 50 includes a plurality of flexible divider sheets 54 and a cover 52 bound together with rings 56 adjacent inside edges 58 of the sheets. Rings 56 provide an alternative to an accordion style spine 22 of holder 10 that may be desirable for handling some types of mail.

Figure 16:
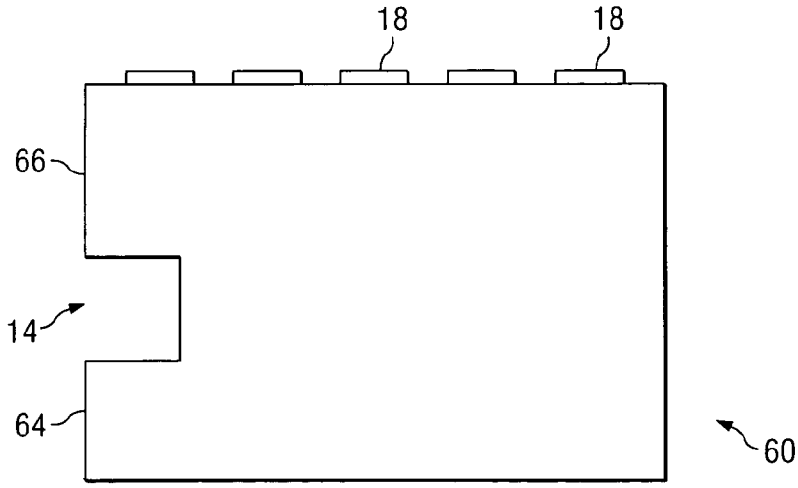
FIGS. 16 and 17 are bottom and side views of another alternative mail holder according to the invention wherein divider sheets are fastened along a single connection point spine.
Figure 17:
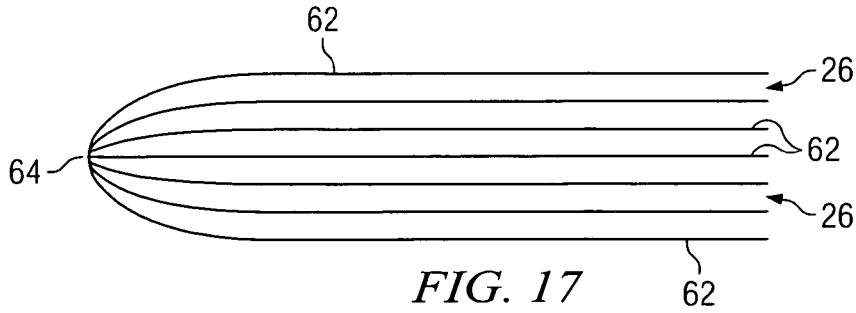

Turning to FIGS. 16 and 17, a mail piece holder 60 comprises a plurality of flexible divider sheets 62 joined together along the inside edge 66 of the sheets with a single edge spine 64 to form pockets 26. Spine 64 may be formed by welding, gluing, binding or otherwise fastening sheets 62 along the inside edge 66 of the sheets. Holder 60 is suitable for handling relatively small mail pieces 15 and/or a small number of mail pieces.

Figure 18:
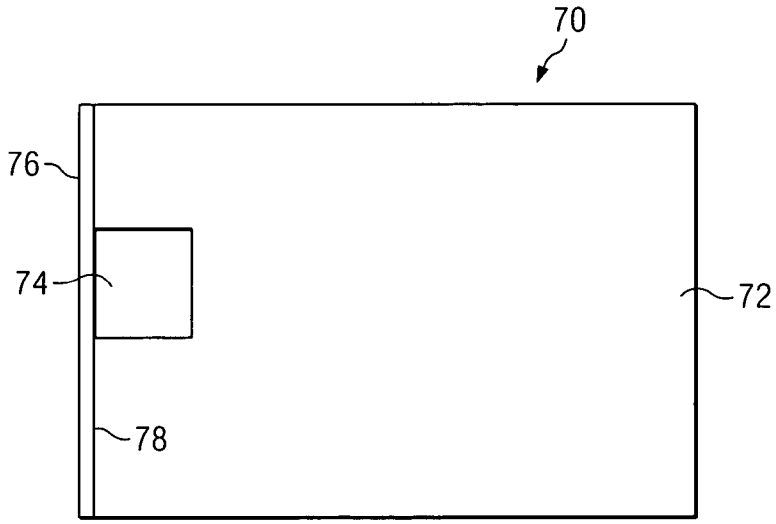
FIG. 18 is a bottom view of an alternative mail holder having a continuous spine that extends across the handhold opening.

Turning to FIG. 18, in yet another variation, a mail holder 70, substantially similar to holder 60 of FIGS. 16 and 17 includes a plurality of divider sheets 72 having inside edges 78. Holder 70 also includes a spine 76 that extends across handhold opening 74 such that the spine is continuous across the height of mail holder 70. As will be appreciated, the holders illustrated in FIGS. 1, 11 and 13 may similarly be provided with a continuous accordion style spine.

Figure 19:
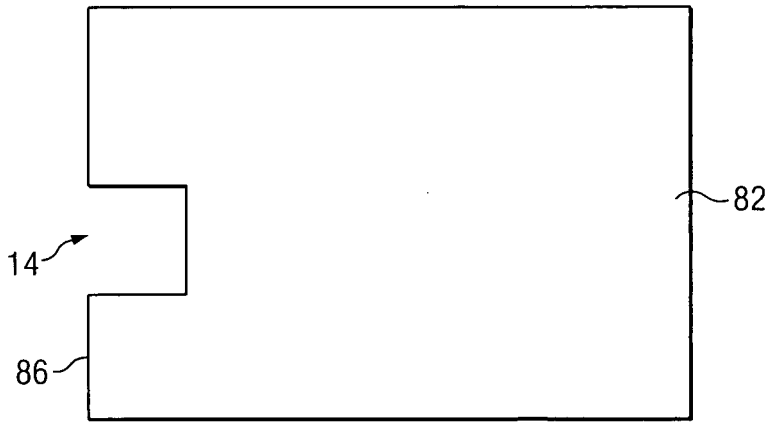
FIG. 19 is a bottom view of a single divider sheet with a handhold opening.
Figure 20:
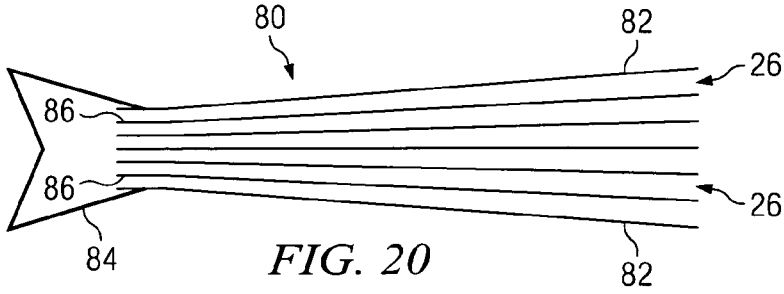
FIG. 20 is a side view of a mail holder assembled from a plurality of the divider sheets of FIG. 19.

Referring to FIGS. 19 and 20 in a further variation, a plurality of flexible sheets 82, each having a handhold opening 14 are fastened together with one or more clamps 84 along the inside edges 86 of sheets 82 to form a mail holder 80. The configuration of holder 80 provides the flexibility of easily increasing or decreasing the capacity of holder 80 by adding or removing sheets 82.

Figure 21:
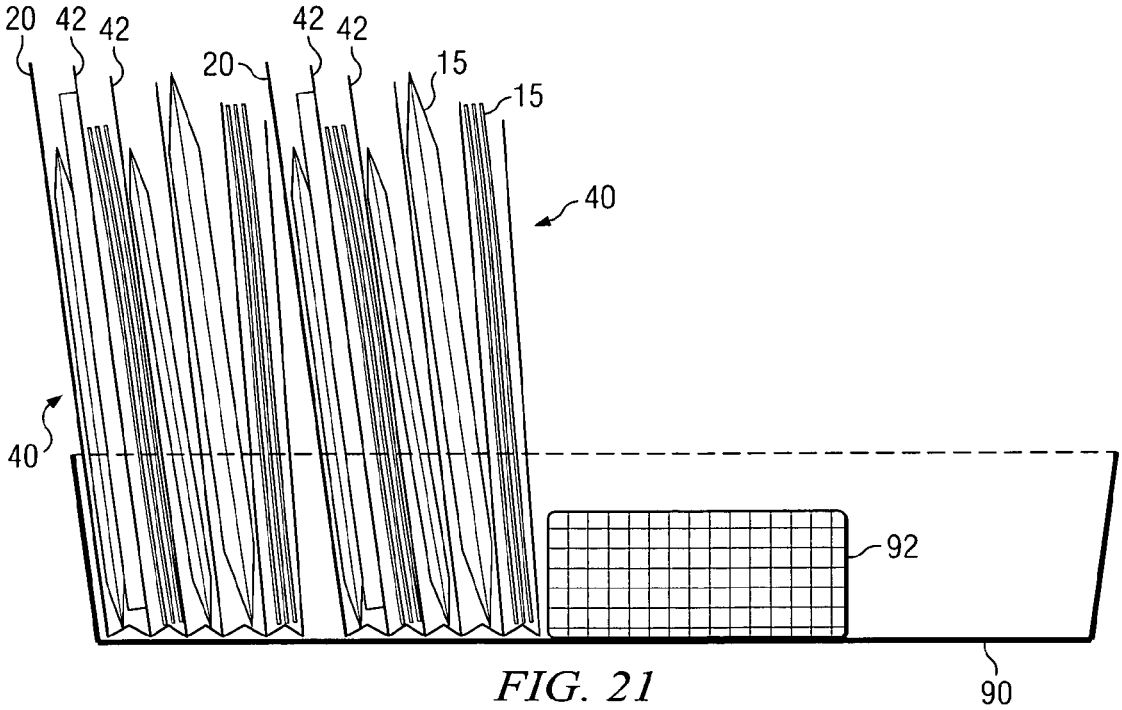
FIG. 21 is a side view of mail holders of the invention braced in place in a mail tray.

Turning to FIG. 21, mail holders according to the invention may be used in connection with curbside routes, where the carrier drives from one mail box to the next. As illustrated, one or more mail holders 40, each loaded with mail pieces 15, are loaded in mail tray 90 and held against one end of the tray with a brick 92. Since the mail pieces have been place in holder 40 in delivery order, the mail carrier merely turns down flexible divider sheets 42 in succession to access the mail for each address receiving mail.

Figure 22:
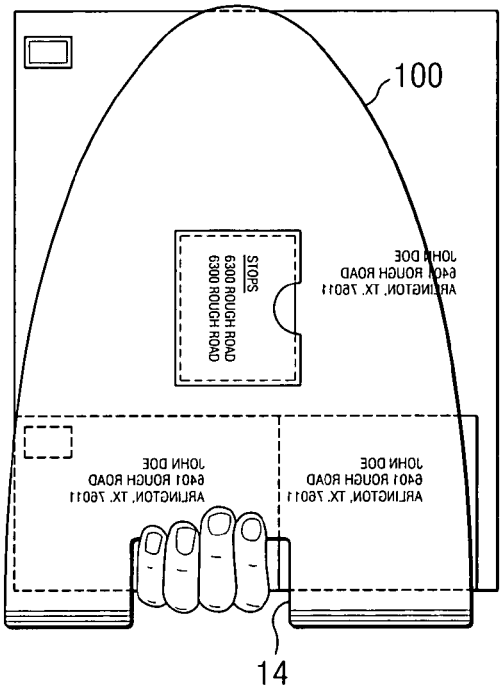
FIGS. 22-24 are top views of a mail holder employing divider sheets having semi ellipsoid, triangular and quarter circle geometries.
Figure 23:
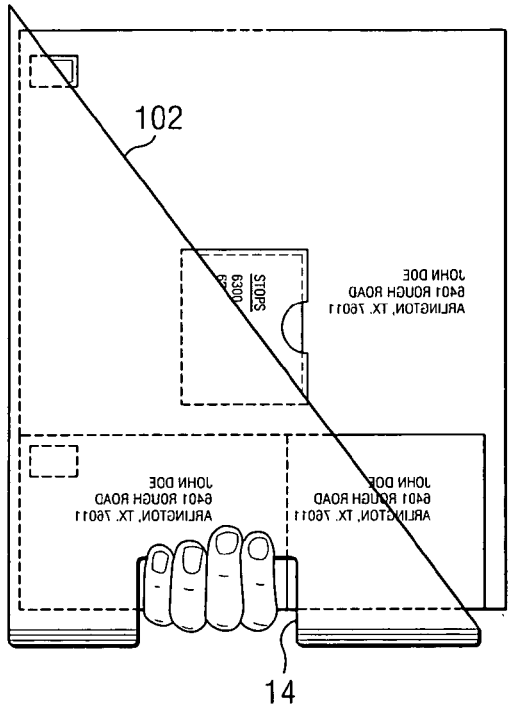
Figure 24:
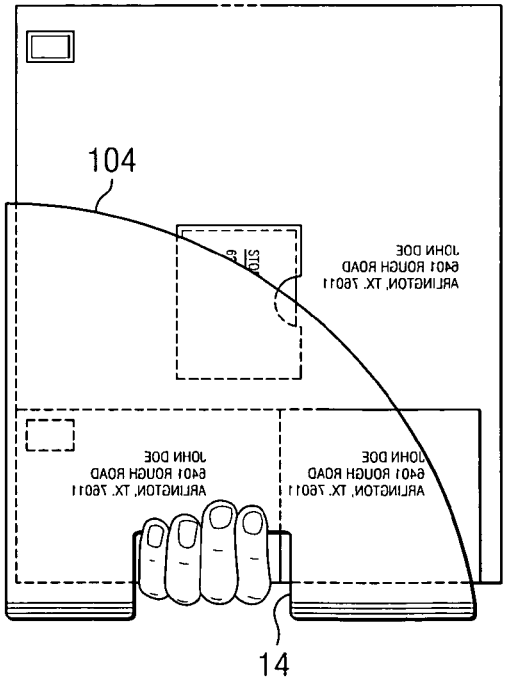
Figure 25:
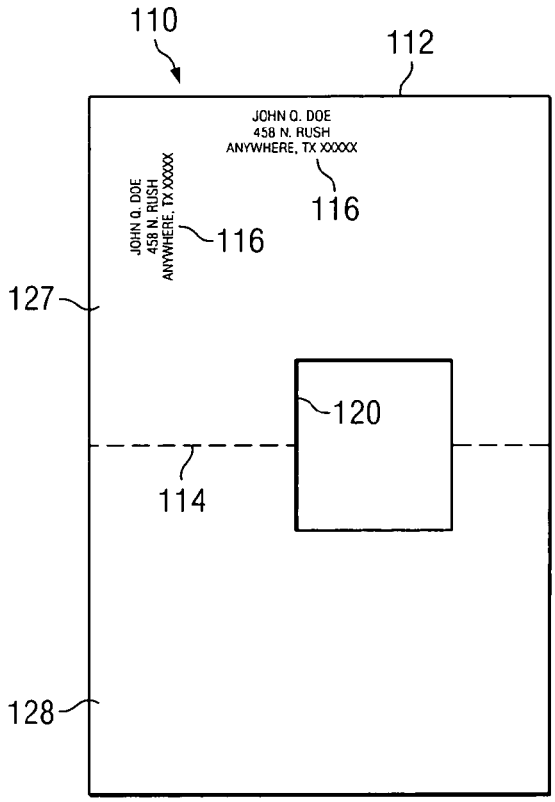
FIG. 25 is front or outside view of an unfolded single sheet mail holder in accordance with the invention.

In some instances it may be preferred or desirable to employ divider sheets having geometries other than rectangular. FIGS. 22, 23 and 24 illustrate divider sheets 100, 102 and 104 having semi ellipsoid, triangular and quarter circular geometries. Other geometries are possible.

Figure 26:
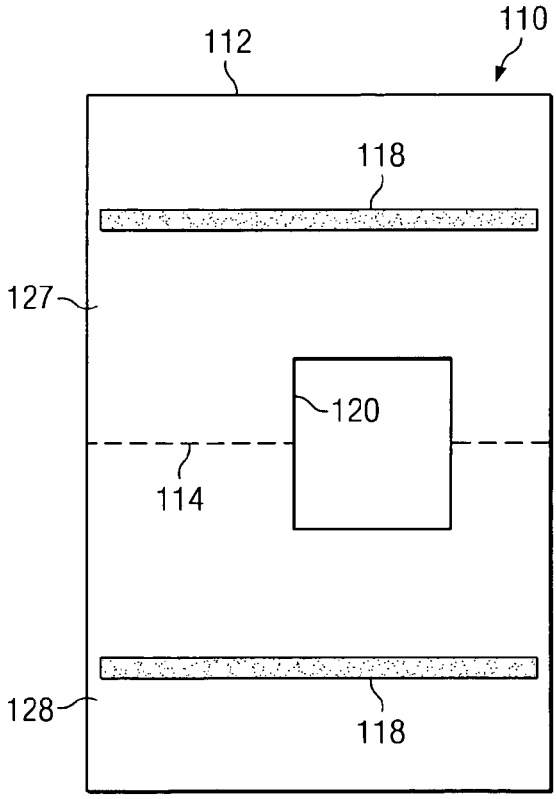
FIG. 26 is back or inside view of an unfolded single sheet mail holder in accordance with the invention.
Figure 27:
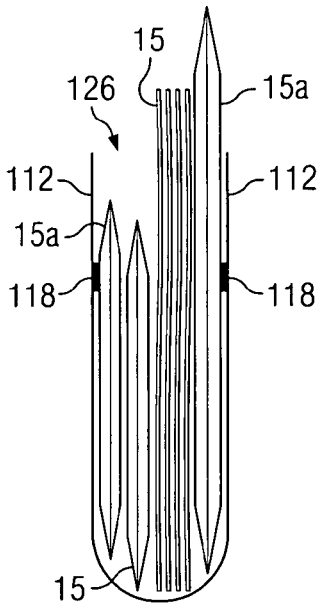
FIG. 27 is a side view of the mail holder of FIG. 25 loaded with mail.
Figure 28:
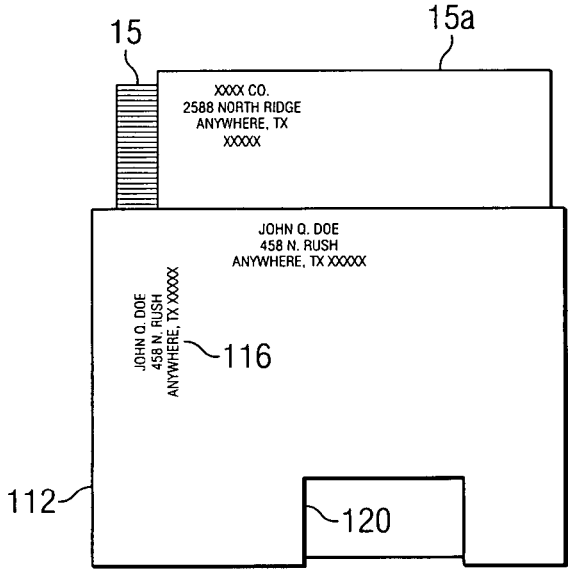
FIG. 28 is a front view of the mail holder of FIG. 25 loaded with mail.

Turning now to FIGS. 25-29, in yet another embodiment, a mail holder 110 comprises a folder, i.e., sheet 112 made of a material designed to be folded across the width of the sheet as indicated by a central fold line 114 to form a single pocket 126 having front and back flaps 127, 128 configured to receive mail pieces 15. Folder 110 may be re-useable, in which case the holder is preferably made from a plastic material such as polyethylene or polypropylene, or from heavy paper or cardboard. Alternatively, a single use folder 110 may be formed from ordinary paper. Preferably, each folder 110 has the address 116 of a recipient on a carrier's route printed vertically and horizontally on the outside of the holder in order to aid the carrier in rapidly identifying the destination of mail pieces 15. As best illustrated in FIGS. 26 and 27, a pair of light tack, releaseable, pressure sensitive adhesive areas or strips 118 (e.g., an adhesive of the type used in 3M Post-It Notes) are positioned on the inside surface of folder 110 to retain the holder in contact with the outside mail pieces 15*a* placed in folder 110. These adhesive strips 118 are preferably spaced from and parallel to central fold line (spine) 114 at an intermediate position of each of flaps 127, 128. Optionally, folder 110 may have a handhold opening 120 to enable the user to control mail pieces 15 placed in the holder.

Figure 29:
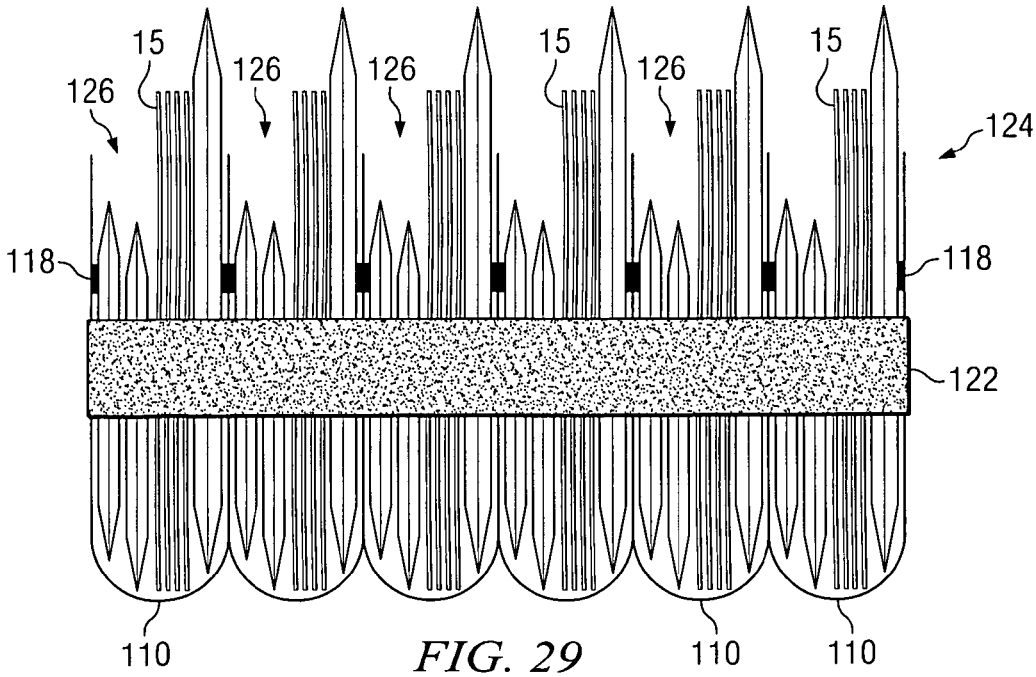
FIG. 29 is a side view of a plurality of mail holders of FIG. 25 each loaded with mail, the mail holders being banded together.

Turning now to FIG. 29, a series of folders 110 may be filled, either manually, or in an automated process, and placed together to form a stack or fastened together with a band 122 to form a bundle 124. Band 122 may be a rubber band, plastic or paper tape, string, or any other material suitable for banding. Folders 110 may also be packaged with shrink-wrap film, paper, or bagged in paper or plastic bags using automated or manual processes. Preferably, folders 110 are arranged in carrier delivery order in bundle 124 to facilitate delivery. Bundles 124 may also be assembled in carrier delivery order by carrier delivery loops such that a carrier may select a bundle 124 for delivery along a carrier loop, remove the band and walk the loop, delivering the pre-sequenced mail to addresses on the loop. A series of folders 110 may also be placed in a tray 90 for curbside delivery as discussed above in connection with FIG. 21.

While the invention has been described in connection with the exemplary embodiments it will be understood that the invention is not limited to the specific embodiments shown. Thus, it will be appreciated that many modifications, combinations, methods, and subcombinations of the invention may be made without departing from the spirit and scope of the appended claims.

The invention claimed is:

1. A system for manual delivery of mail to a series of recipients, comprising a stack of mail holders each comprising a front flap, a back flap and a central fold; and one or more mail pieces disposed in each holder, wherein all of the mail pieces in each holder are to be delivered to the same recipient, and the holders are stacked in a predetermined order for a carrier delivery route, wherein the front and back flaps of each holder are folded about the central fold forming a folder so that the flaps are on opposite sides of the mail pieces, and in the stack the holders are stacked such that the back flap of one holder is in face-to-face relationship with the front flap of an adjacent holder, wherein each holder further comprises areas of releaseable contact adhesive on inner faces of the front and back flaps in positions effective to hinder mail in the holder from coming out of the holder until the holder is opened.

2. A system for manual delivery of mail to a series of recipients, comprising:

a stack of mail holders each comprising a front flap, a back flap and a central fold, one flap of the holder having a destination address for the recipient printed on an outer face thereof, the holders stacked such that the back flap of one holder is in face-to-face relationship with the front flap of an adjacent holder, each mail holder having a handhold opening in its central fold, which opening is configured to enable a user to control mail pieces placed in the holder, and the holders are stacked so that the handhold openings are in alignment with each other; and one or more mail pieces disposed in each holder, wherein all of the mail pieces in each holder are to be delivered to the same recipient, wherein the holders are stacked in a predetermined order for a carrier delivery route for the mail pieces, and the front and back flaps of each holder are folded about the central fold forming a folder open on three sides so that the flaps are on opposite sides of the mail pieces inside each holder, and the mail can be exposed for removal by opening the folder, and wherein each holder further comprises areas of releasable contact adhesive on inner faces of the front and back flaps in positions effective to hinder mail in the holder from coming out of the holder until the holder is opened.

3. The system of claim 2, further comprising means for holding the stack together until time of delivery.

4. The system of claim 2, wherein the handhold opening of each holder extends symmetrically into the front and back flaps on opposite sides of the central fold.

5. The system of claim 2, wherein each handhold opening is located closer to a near edge of the holder than to the other edge thereof, and bottom edges of the mail pieces on the holder are substantially aligned with the near edge.

* * * * *